US007686704B2

(12) United States Patent
Gilbert et al.

(10) Patent No.: US 7,686,704 B2
(45) Date of Patent: Mar. 30, 2010

(54) IRON-TYPE GOLF CLUBS

(75) Inventors: Peter J. Gilbert, Carlsbad, CA (US); Bruce R. Pettibone, Carlsbad, CA (US)

(73) Assignee: Acushnet Golf, Fairhaven, MA (US)

( * ) Notice: Subject to any disclaimer, the term of this patent is extended or adjusted under 35 U.S.C. 154(b) by 0 days.

(21) Appl. No.: 11/695,105

(22) Filed: Apr. 2, 2007

(65) Prior Publication Data

US 2008/0242439 A1 Oct. 2, 2008

(51) Int. Cl.
*A63B 53/00* (2006.01)

(52) U.S. Cl. ..... 473/290; 473/350; 473/409

(58) Field of Classification Search ..... 473/409, 473/287, 290–291, 350
See application file for complete search history.

(56) References Cited

U.S. PATENT DOCUMENTS 5,290,036 A * 3/1994 Fenton et al. ..... 473/332
5,401,021 A * 3/1995 Allen ..... 473/291
5,429,353 A * 7/1995 Hoeflich ..... 473/350
5,695,410 A * 12/1997 Brown ..... 473/305
5,795,240 A * 8/1998 Chappell ..... 473/291
6,045,456 A * 4/2000 Best et al. ..... 473/291
6,093,112 A * 7/2000 Peters et al. ..... 473/291
6,309,309 B1 * 10/2001 Beach et al. ..... 473/290
6,743,117 B2 6/2004 Gilbert
6,875,124 B2 4/2005 Gilbert et al.
2004/0214655 A1 * 10/2004 Reed et al. ..... 473/290
2006/0234805 A1 10/2006 Gilbert et al.
2006/0234806 A1 10/2006 Gilbert et al.
2006/0234809 A1 10/2006 Gilbert et al.

* cited by examiner

*Primary Examiner*—Stephen L. Blau
(74) *Attorney, Agent, or Firm*—Kristin D. Wheeler

(57) ABSTRACT

The present invention is directed to a number of customized sets of iron-type golf clubs selected from a relatively small number of clubs. The multiple custom-fitted iron sets can be achieved by pivoting these sets off a common 6-iron. In a preferred embodiment, a portfolio of clubs contains seventeen forged iron-type golf clubs, wherein the clubs are a blended collection of oversized cavity back-type clubs, mid-sized clubs, and standard-sized muscle back-type clubs, which can be configured to create at least four custom-fitted iron sets pivoted off a common 6-iron.

13 Claims, 3 Drawing Sheets

| | | | | | | | | | |
|---|---|---|---|---|---|---|---|---|---|
| | 2 | 3 | 4 | 5 | | | | | |
| MS | 2 | 3 | 4 | 5 | 6 | 7 | 8 | 9 | W |
| MB | | | | | | 7 | 8 | 9 | W |

FIG. 2

| | | | | | | | | | |
|---|---|---|---|---|---|---|---|---|---|
| OS | | 3 | 4 | 5 | | | | | |
| MS | 2 | 3 | 4 | 5 | 6 | | 8 | 9 | W |
| MB | | | | | | 7 | 8 | 9 | W |

FIG. 3

| | | | | | | | | | |
|---|---|---|---|---|---|---|---|---|---|
| OS | | 3 | 4 | 5 | | | | | |
| MS | 2 | 3 | 4 | 5 | 6 | 7 | 8 | 9 | W |
| MB | | | | | | 7 | 8 | 9 | W |

FIG. 4

| | | | | | | | | | |
|---|---|---|---|---|---|---|---|---|---|
| OS | | 3 | 4 | 5 | | | | | |
| MS | 2 | 3 | 4 | 5 | 6 | 7 | 8 | 9 | W |
| MB | | | | | | 7 | 8 | 9 | W |

FIG. 5

IRON-TYPE GOLF CLUBS

FIELD OF THE INVENTION

This invention generally relates to golf clubs, and, more particularly, to mixed sets of iron clubs.

BACKGROUND OF THE INVENTION

Individual iron club heads in a set typically increase progressively in face surface area and weight as the clubs progress from the long irons to the short irons and wedges. The club heads of the long irons have a smaller face surface area than the short irons and are typically more difficult for the average golfer to hit consistently well. For conventional club heads, this arises at least in part due to the smaller sweet spot of the corresponding smaller face surface area and due to longer shaft length.

Golfers of different skill levels prefer golf clubs with different design configurations. Recreational golfers and high handicap players generally prefer cavity back irons, because the perimeter weighting is more forgiving on mishits, especially with the long irons. Additionally, recreational golfers also prefer oversized clubs, especially in the long irons, to improve the chance of hitting the ball properly. On the other hand, mid-handicap and low handicap players prefer the mid-size clubs.

Professional and low handicap golfers prefer muscle back irons due to their superior workability and ability to shape shots. Muscle back clubs also possess the classic appearance valued by most golfers. The mid-handicap players, on the other hand, prefer the forgiving clubs for the long irons and workable clubs for the short irons.

In order for golfers to customize their sets, golf manufacturers would have to manufacture complete sets of oversized cavity backs (3-iron-P), mid-sized cavity backs (2-iron-P) and muscle backs (2-iron-P) and warehouse them, without knowing which individual clubs the buyers would choose. This can cause uneven distribution in the manufacturing-to-sale channel, and increases the number of SKUs (stock keeping units) that manufacturers and retailers must keep. Furthermore, the buyer may choose individual clubs that are not optimal for their plays.

Hence, their remains a need for a system that allows the golf club buyers to customize and optimize their iron set and for the golf manufacturers to optimize production and minimize the number of SKUs.

SUMMARY OF THE INVENTION

The present invention is directed to a custom set of iron-type golf clubs selected from a portfolio of clubs. The portfolio comprises a mid-sized set of iron clubs comprising a 2-iron club to a 9-iron club and at least one wedge, wherein the 6-iron mid-sized club is a pivot club; a plurality of oversized cavity back-type long iron clubs; and a plurality of standard sized muscle back-type short iron clubs. The custom set comprises the pivot club; said plurality of oversized cavity back-type long iron clubs, or a plurality of long iron clubs from said mid-sized set; and said plurality of muscle back-type short iron clubs, or a plurality of short iron clubs from said mid-sized set.

In one aspect of the invention, the custom set of iron-type golf clubs is selected from a portfolio of clubs wherein the mid-sized set comprises at least one cavity back-type club or at least one channel back-type club.

In one aspect of the invention, the custom set of iron-type golf clubs is selected from a portfolio of clubs wherein at least one iron-type golf club comprises an insert such as a vibration dampening insert or a mass control insert.

BRIEF DESCRIPTION OF THE DRAWINGS

In the accompanying drawings, which form a part of the specification and are to be read in conjunction therewith and in which like reference numerals are used to indicate like parts in the various views:

FIG. 2 is a diagram illustrating one set of custom-fitted iron-type golf clubs selected from the portfolio depicted in FIG. 1.

FIG. 3 is a diagram illustrating a second set of custom-fitted iron-type golf clubs selected from the portfolio depicted in FIG. 1.

FIG. 4 is a diagram illustrating a third set of custom-fitted iron-type golf clubs selected from the portfolio depicted in FIG. 1.

FIG. 5 is a diagram illustrating a fourth set of custom-fitted iron-type golf clubs selected from the portfolio depicted in FIG. 1.

DETAILED DESCRIPTION OF THE INVENTION

Figure 1:
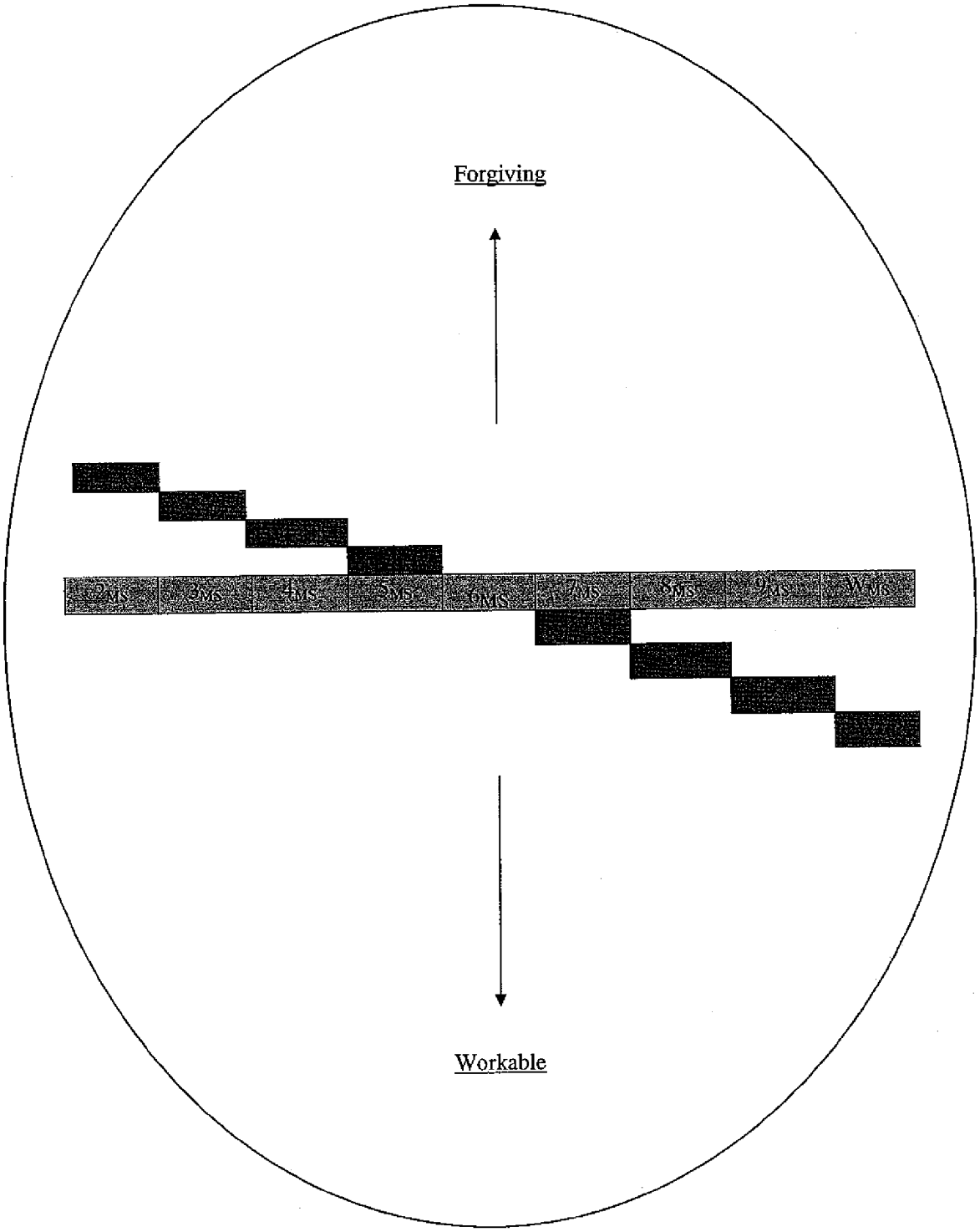
FIG. 1 is a diagram illustrating a portfolio of iron-type golf clubs.

As illustrated in the accompanying drawings and discussed in detail below, one aspect of the present invention is directed to a number of customized sets of iron-type golf clubs selected from a relatively small number of clubs. The multiple custom-fitted iron sets can be achieved by pivoting these sets off of a common 6-iron. In a preferred embodiment, a portfolio of clubs contains seventeen iron-type golf clubs, wherein the clubs are a blended collection of oversized cavity back-type clubs, mid-sized clubs, and standard-sized muscle back-type clubs, which can be configured to create at least four custom-fitted iron sets pivoted off a common 6-iron. Other combinations and number of clubs can also be used.

As used herein the term "portfolio" refers to a collection of iron-type golf clubs with one or more long irons (defined herein as a 2-iron, 3-iron, 4-iron, or 5-iron), a pivot club (i.e., the 6-iron) and one or more short irons (defined herein as a 7-iron, 8-iron, 9-iron, pitching wedge or sand wedge), and wherein each numbered iron may be represented more than once within the collection. Additionally, as discussed in greater detail below, the portfolio of golf clubs can have mid-sized and oversized clubs as well as cavity backs, muscle backs, and channel backs (i.e., clubs with a channel on the back to receive one or more inserts).

As used herein the term "set" refers to collection of iron-type golf clubs with one or more long irons, a pivot club, and one or more short irons, and wherein each numbered iron is represented only once within the collection. Typically, a set contains 2-iron to 9-iron clubs and a pitching wedge or sand wedge.

A golf club's design configuration can be influenced by several design parameters. One such parameter is the configuration of a golf club head's rear face. In typical sets of golf clubs, a club head's rear face has either a "cavity back"

configuration, i.e., a substantial portion of the mass of the club head is positioned on the back side around the perimeter of the club head, or a "muscle back" configuration, where the mass of the club is relatively evenly distributed along the heel-to-toe length of the club head body. Further discussion of cavity back and muscle back design configurations can be found in commonly owned, co-pending United States Patent Application Publication No. 2006/0234806, which is incorporated herein by reference in its entirety.

Cavity back clubs tend to have larger sweet spots, lower centers of gravity, and higher rotational moment of inertia. In other words, cavity back clubs are easier to produce true hits. In long irons, the sweet spot can be difficult to hit accurately. Therefore, it is desirable for the long irons to have cavity back configurations.

Muscle back clubs tend to have relatively small sweet spots, higher centers of gravity, and lower rotational moment of inertia about the shaft axis. If struck correctly, muscle back clubs often yield greater overall performance or workability due to the mass (or muscle) behind the sweet spot, but are more difficult to hit accurately by the average golfer due to the smaller sweet spot. As short irons tend to be easier to hit true for the average golfer, but workability can be lacking, it is desirable for the short irons to have muscle back configurations.

Another design configuration is a "channel back" which is similar to a cavity back with an undercut flange positioned near the sole to move the center of gravity rearward. More specifically, a channel back club head includes a body made of a forged or cast material with a hitting face integrally formed on the body. A rear flange is connected to the hitting face, with a channel formed within the rear flange between the rear flange and the hitting face. Further discussion of the channel back design can be found in commonly owned, co-pending United States Patent Application Publication Nos. 2006/0234809 and 2006/0234806, which are incorporated herein by reference in their entirety.

Inserts can be used to adjust a variety of golf club design parameters, including the aesthetics, vibration characteristics, and mass distribution of the club head. According to the present invention, the inserts are preferably placed in the rear face of the golf club head (e.g., the channel of the channel back-type clubs), but other locations such as the front face are also contemplated. Further discussion of inserts can be found in commonly owned U.S. Pat. Nos. 6,743,117 and 6,875,124 as well as commonly owned United States Patent Application Publication No. 2006/0234805, which are incorporated herein by reference in their entireties.

Figure 6C:
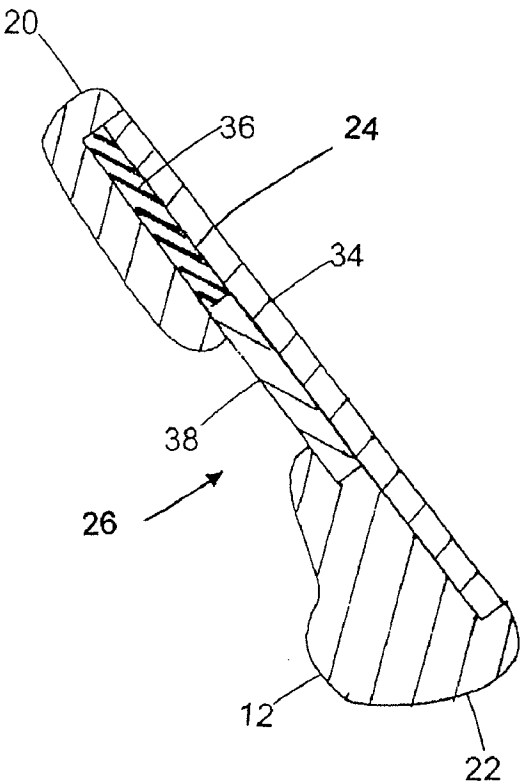
FIG. 6*c* is a cross-sectional view of a wedge of the embodiment of FIG. 6*a*.
Figure 6B:
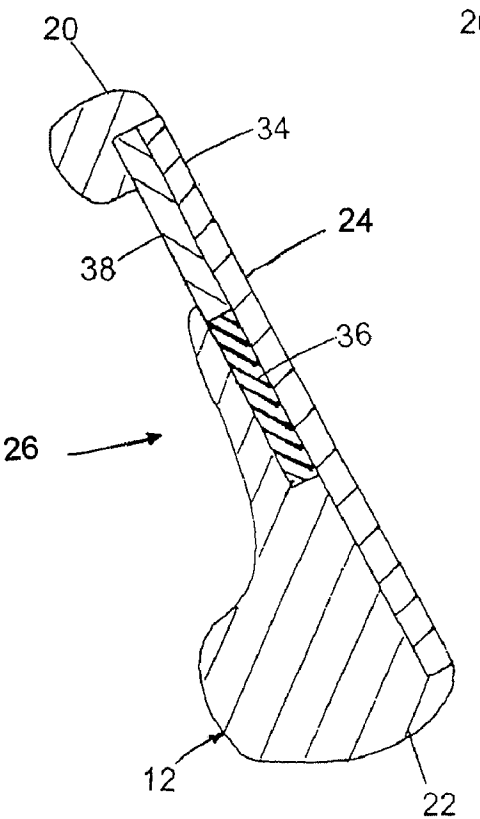
FIG. 6*b* is a cross-sectional view of a mid-iron of the embodiment of FIG. 6*a*.
Figure 6A:
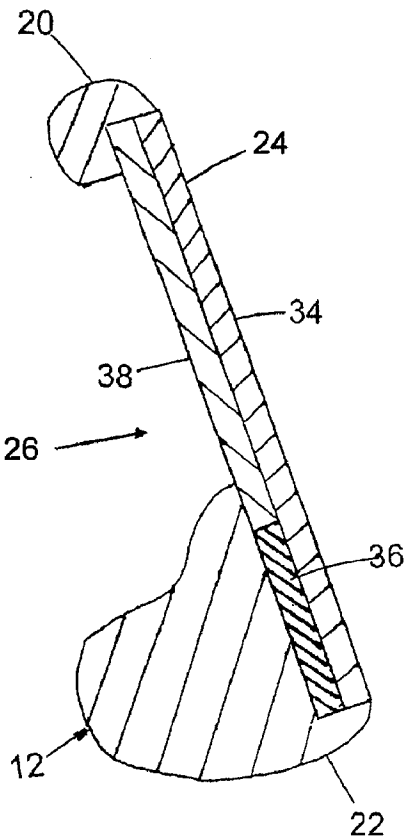
FIG. 6*a* is a cross-sectional view of a long iron of an alternate embodiment of the invention.

As shown in FIGS. 6*a* though 6*c*, placed into a cavity 26, in back of a strike face insert 34 is a vibration dampening insert 36, which dissipates the vibration energy effectively enough to minimize resonance and propagation of vibrations, as well as to reduce acoustic noises. Drawings 6*a*-6*c* depict the dimensional concept wherein the location of a heavier weighted dampening insert 36 is positioned higher to achieve a higher center of gravity in the higher numerically sequenced irons. In FIG. 6*a*, the dampening insert 36 is at a relatively low position for the 2 iron head, thereby giving it a higher launch projectory. In FIG. 6*b*, in the iron head depicting a 6 iron, the dampening insert 36 is about at the midpoint between lower edge 22 and upper edge 20 thereby raising the specific gravity for a lower projectory and therein giving the golfer an added measure of control over the shot. In FIG. 6*c*, the dampening insert 36 is yet still at a point further away from the lower edge 22 thereby providing the short wedge iron with a high center of gravity for better shot control. As previously stated, as a club sequence number gets progressively higher, the shaft becomes shorter and is accompanied by an increasing weight of the head. Further, the larger a club number becomes, the larger a loft angle or an angle of front portion 24 to a vertical plane becomes. Furthermore, the larger a club number becomes, the larger a lie angle or an angle of the shaft to a horizontal plane becomes as well.

According to one aspect of the invention, the insert can be a vibration dampening insert or "dampening chip" that adjusts a club's swing weight while also providing relief for vibration and acoustical variations. The dampening chip absorbs a portion of the shock of impact to reduce vibrations of the club for a better feel during play. The dampening chip may be any type of resilient material known in the art for dampening vibrations such as rubber or urethane. The dampening chip may be also any visco-elastic material. The dampening chip is preferably configured to be press fit into a void formed in the rear face of the club head and securing it therewithin with an adhesive such as epoxy. Preferably, the dampening element is generally quadrilateral in shape.

According to another aspect of the invention, a club head can be adapted to receive a mass control insert in order to optimize a golf club head's mass distribution properties (i.e., moment of inertia and center of gravity). Specifically, the mass distribution properties can be optimized by having the density of the mass control insert be greater or lower than that of the club head body. For example, if the club head is made of forged stainless steel, the mass control insert may be made from aluminum or titanium, both of which are materials with significantly lower densities than that of steel. Consequently, the mass of club head is shifted toward the perimeter thereof, and the club provides more forgiveness to off-center hits. Alternatively, if the club head is made of forged stainless steel, the mass control insert may be made from tungsten to increase the mass behind the hitting face, thereby yielding greater workability.

The golf club heads can also have different size configurations. Oversized club heads, mid-sized club heads, and standard sized club heads are well known in the art. In one aspect of the present invention, golf club sets preferably have oversized club heads in the long irons, i.e., club heads that are larger or substantially larger than standard or traditional club heads, and mid-sized or standard-sized club heads in the short irons. In this manner, the long irons are relatively easier to hit accurately while the workability of the short irons is maintained. Generally, the face area increases from standard-sized to mid-sized to oversized club heads. For example, mid-sized clubs may have a face area that is about 3 to about 10 percent larger than the face area of traditional or standard-sized club heads and oversized clubs may have a face area that is at least about 10 percent larger and preferably from about 10 to 25 percent larger than the face area of traditional or standard-sized club heads. Generally, the face area is the entire flat region of the front face of the club head. Additionally, mid-sized club heads having a cavity back may generally have a cavity volume of at least 8 cc and the oversized club heads may generally have a cavity volume of at least 10 cc and preferably at least 12 cc.

The design elements discussed above are incorporated into the present invention, which is directed to a number of customized sets of iron-type golf clubs selected from a portfolio of clubs. Although the portfolio can comprise any number of clubs, in order to minimize the number of stock keeping units (SKUs), the portfolio comprises a relatively small number of clubs, preferably a collection of seventeen iron-type golf clubs.

FIG. 1 illustrates a portfolio of iron-type golf clubs according to one embodiment of the present invention. Each individual box represents an individual iron, denoted by an iron-number, or a wedge, denoted by "W." Further, the subscript below each iron-number or W denotes a club's design configuration (i.e., "OS" denotes an oversized cavity back-type club, "MS" denotes a mid-sized clubs, and "MB" denotes a standard sized muscle back-type club). Moreover, clubs that are placed closer towards the top of FIG. 1 are more forgiving on mishits, whereas clubs that are placed closer towards the bottom of FIG. 1 provide superior workability.

As depicted in FIG. 1, the portfolio of iron-type clubs comprises three groups of clubs, which are directed to golfers of different skill levels. One group contains four oversized cavity back-type clubs (i.e., a 2-iron, 3-iron, 4-iron, and 5-iron). The combined perimeter-weighting and oversized design allows these clubs to be more forgiving on mishits, and, thus, these clubs are preferred by recreational golfers as well as high- to mid-handicap players. Because of their user friendly performance, this first group of clubs has a broad reach in the golf club market.

A second group contains nine mid-sized clubs: a 2-iron, 3-iron, 4-iron, 5-iron, 6-iron, 7-iron, 8-iron, 9-iron, and a pitching wedge or sand wedge. The mid-sized clubs can have any design configuration, but in one preferred embodiment, the clubs have a cavity back-type design configuration. The mid-sized clubs are preferred by mid- to low-handicap players because they provide a forgiving design and good workability. This second group of clubs has a moderate reach in the golf club market.

A third group contains four standard-sized muscle back-type clubs: a 7-iron, 8-iron, 9-iron, and a pitching wedge or sand wedge. The muscle back-type clubs are preferred by professionals as well as mid- to low-handicap players because of their superior workability and ability to shape shots. This third group of clubs has a mild reach in the golf club market.

Although the portfolio depicted in FIG. 1 illustrates cavity back-type clubs and muscle back-type clubs, it is possible for the portfolio to comprise channel back-type clubs, which are discussed above. Moreover, an insert can be placed within a recess in the rear face of any of the golf club heads of the portfolio. As discussed in greater detail above, inserts such as vibration dampening inserts and mass control inserts can be used to adjust a variety of design parameters including aesthetics, vibration characteristics, and mass distribution.

Because the portfolio depicted in FIG. 1 comprises golf clubs with design configurations preferred by players of different skill levels, one can advantageously use this portfolio to form at least four custom-fitted iron sets by pivoting these sets off a common 6-iron. These so-called "pivot sets" are generally configured by selecting the 6-iron (the "pivot club"), selecting at least one long iron from the group of oversized cavity-back type clubs or the group of mid-sized clubs, and selecting at least one short iron from the group of mid-sized clubs or the group of standard sized muscle back-type clubs. Subsequently, the selected iron-type golf clubs are tested to see if they suit a golfer's needs. After testing the selected iron-type golf clubs, one may substitute the at least one long iron with at least one other long iron. Similarly, one may substitute the at least one short iron with at least one other short iron.

FIGS. 2-5 illustrate pivot sets selected from the portfolio depicted in FIG. 1. Each individual box represents an individual iron, denoted by an iron-number, or a wedge, denoted by "W." The shaded boxes denote the clubs selected for a particular pivot set, whereas the unshaded boxes designate unselected clubs in the portfolio. The left most column denotes club design configuration (i.e., "OS" denotes an oversized cavity back-type club, "MS" denotes a mid-sized clubs, and "MB" denotes a standard sized muscle back-type club).

FIG. 2 illustrates one pivot set selected from the portfolio depicted in FIG. 1. The pivot set is configured by combining the pivot club with oversized cavity back-type long irons and mid-sized short irons. The heavily shaded triangle 10 on the left indicates that the oversized cavity back-type long irons are favored by a broad number of golfers (about 6 million), whereas the half-shaded triangle 20 on the right indicates that the mid-sized short irons are favored by a moderate number of golfers (about 2 million). Overall, this pivot set configuration provides the most user-friendly or most forgiving performance, and it is directed to golfers with an 8-15 handicap, i.e. serious and recreational golfers.

FIG. 3 illustrates a second pivot set selected from the portfolio depicted in FIG. 1. The pivot set is configured by combining the pivot club with mid-sized long irons and mid-sized short irons. The half-shaded triangles 10 on the left and right indicate that both the long irons and shorts are favored by a moderate number of golfers (about 2 million). Overall, this pivot set configuration provides moderate forgiveness and good workability, and it is directed to golfers with a handicap not exceeding 10, i.e. aspirational and professional golfers.

FIG. 4 illustrates a third pivot set selected from the portfolio depicted in FIG. 1. The pivot set is configured by combining the pivot club with mid-sized long irons and standard-sized muscle back-type short irons. The half-shaded triangle 10 on the left indicates that the mid-sized long irons are favored by a moderate number of golfers (about 2 million), whereas the sparsely shaded triangle 30 on the right indicates the standard sized muscle back-type short irons are favored by a mild number of golfers. Overall, this pivot set configuration is mildly forgiving, as a whole; it comprises a blend of moderately forgiving long irons and very workable short irons. Thus, it is directed to golfers with a handicap not exceeding 8, i.e. professional golfers.

FIG. 5 illustrates a fourth pivot set selected from the portfolio depicted in FIG. 1. The pivot set is configured by combining the pivot club with oversized cavity back-type long irons and standard sized muscle back-type short irons. The heavily shaded triangle 10 on the left indicates that the oversized cavity-back type long irons are favored by a broad number of golfers (about 6 million), whereas the sparsely shaded triangle 30 on the right indicates the standard sized muscle back-type short irons are favored by a mild number of golfers. Overall, this pivot set configuration is the most versatile set as it combines easy to hit long irons with very workable short irons, and thus it is directed to a broad range of golfers with a handicap up to 15, i.e., professional golfers, aspirational golfers, serious golfers, and recreational golfers.

Hence, the present invention provides a method for customizing iron sets and minimizing SKUs at the same time. This method also prevents inefficient selection of clubs, e.g., workable long irons and forgiving short irons.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A custom set of iron-type golf clubs selected from a portfolio of clubs from a single manufacturer, wherein a.) said portfolio comprises i. a mid-sized set of iron clubs comprising a 2-iron club to a 9-iron club and at least one wedge, wherein the 6-iron mid-sized club is a pivot club;

ii. a plurality of oversized cavity back-type long iron clubs; and iii. a plurality of standard sized muscle back-type short iron clubs; and b.) said custom set comprises i. the pivot club;

ii. said plurality of oversized cavity back-type long iron clubs, or a plurality of long iron clubs from said mid-sized set; and iii. said plurality of muscle back-type short iron clubs, or a plurality of short iron clubs from said mid-sized set, wherein said custom set comprises said plurality of oversized cavity back-type long iron clubs and a plurality of short iron clubs from said mid-sized set.

2. The custom set of iron-type golf clubs selected from a portfolio of clubs according to claim 1 wherein said mid-sized set comprises at least one cavity back-type club.

3. The custom set of iron-type golf clubs selected from a portfolio of clubs according to claim 1 wherein said mid-sized set comprises at least one channel back-type club.

4. The custom set of iron-type golf clubs selected from a portfolio of clubs according to claim 1 wherein at least one iron-type golf club comprises an insert.

5. The custom set of iron-type golf clubs selected from a portfolio of clubs according to claim 4 wherein said insert is a vibration dampening insert.

6. The custom set of iron-type golf clubs selected from a portfolio of clubs according to claim 4 wherein said insert is a mass control insert.

7. The custom set of iron-type golf clubs selected from a portfolio of clubs according to claim 6 wherein said mass control insert has a density lower than that of a head of said at least one iron-type golf club.

8. The custom set of iron-type golf clubs selected from a portfolio of clubs according to claim 6 wherein said mass control insert has a density greater than that of said at least one iron-type golf club head body.

9. The custom set of iron-type golf clubs according to claim 1, wherein the portfolio comprises seventeen clubs.

10. The custom set of iron-type golf clubs according to claim 1, wherein the irons have a face area and the face area of the mid-sized clubs is at least 3 to 10 percent greater than the face area of the standard muscle back clubs.

11. The custom set of iron-type golf clubs according to claim 1, wherein the irons have a face area and the face area of the oversized clubs is at least 10 percent greater than the face are of the standard muscle back clubs.

12. The custom set of iron-type golf clubs according to claim 1, wherein the mid-sized clubs have a cavity volume of at least 8 cc.

13. The custom set of iron-type golf clubs according to claim 1, wherein the over-sized clubs have a cavity volume of at least 10 cc.

* * * * *